US012449243B2

(12) United States Patent
Weiland

(10) Patent No.: US 12,449,243 B2
(45) Date of Patent: Oct. 21, 2025

(54) TUNABLE PROJECTILE

(71) Applicant: Christopher J. Weiland, Fredericksburg, VA (US)

(72) Inventor: Christopher J. Weiland, Fredericksburg, VA (US)

( * ) Notice: Subject to any disclaimer, the term of this patent is extended or adjusted under 35 U.S.C. 154(b) by 0 days.

(21) Appl. No.: 18/611,798

(22) Filed: Mar. 21, 2024

(65) Prior Publication Data

US 2025/0297840 A1 Sep. 25, 2025

(51) Int. Cl.
*F42B 12/74* (2006.01)
*F42B 12/02* (2006.01)
*F42B 30/02* (2006.01)

(52) U.S. Cl.
CPC ..... *F42B 12/74* (2013.01); *F42B 12/02* (2013.01); *F42B 30/02* (2013.01)

(58) Field of Classification Search
CPC ..... F42B 12/02; F42B 12/74; F42B 30/02
USPC ..... 102/502
See application file for complete search history.

(56) References Cited

U.S. PATENT DOCUMENTS

| | | | | |
|---|---|---|---|---|
| 7,373,887 | B2 * | 5/2008 | Jackson | F42B 12/34 102/517 |
| 8,479,656 | B2 * | 7/2013 | Ciesiun | F42B 12/40 102/513 |
| 2012/0216697 | A1 * | 8/2012 | Jacobsen | F41B 9/0093 89/7 |
| 2016/0258726 | A1 * | 9/2016 | Sullivan | F42B 10/48 |

FOREIGN PATENT DOCUMENTS

| | | | | |
|---|---|---|---|---|
| CN | 111504138 A | * | 8/2020 | A62D 1/005 |
| DE | 102013004027 A1 | * | 4/2014 | F42B 12/34 |

OTHER PUBLICATIONS

Machine translation of DE_102013004027_A1 (Year: 2014).*
Machine translation of CN_111504138_A (Year: 2020).*

* cited by examiner

*Primary Examiner* — James S Bergin

(57) ABSTRACT

An apparatus including a non-Newtonian fluid disposed within a projectile.

19 Claims, 2 Drawing Sheets

TUNABLE PROJECTILE

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to firearms. In particular, ammunition for firearms.

There are many examples of non-lethal projectiles such as bean bags and rubber bullets. However, many times non-lethal rounds are lethal or cause permanent damage to the human. The disclosed projectile provides an opportunity to escalate the intensity of their crowd control weapon as required and minimizes the likelihood that an over or under application of force will be used because an operator can "tune" exactly how much force is applied as the situation escalates.

The disclosed projectile has many advantages over present non-lethal rounds. Modern non-lethal rounds can do great harm to humans, as one cannot determine the amount of impact force the round has before firing the round.

There are some rifles that do permit tuning the muzzle velocity of the projectile, essentially increasing or decreasing the impact energy. However, projectile dynamics are greatly influenced by the muzzle velocity, so modifying the muzzle velocity means that the flight dynamics can change depending on how far away the target is from the rifle. It is undesirable to change round ballistics, as this decreases the probability the projectile will strike the intended aim point.

SUMMARY

In one embodiment, a non-Newtonian fluid disposed within a projectile is disclosed. A non-Newtonian fluid is a fluid that has a variable viscosity dependent on stress. In particular, the viscosity of non-Newtonian fluids can change when subjected to force. In some embodiments, the projectile further includes an ultrasonic signal generator configured to emit vibrations at frequencies to tune the viscosity of the non-Newtonian fluid to a desired level of lethality. In some embodiments, the projectile further includes a vibration surface in direct contact with the non-Newtonian fluid, wherein the vibration surface is configured to impart vibrations generated by the ultrasonic signal generator to the non-Newtonian fluid. In some embodiments, the projectile further includes a power source housed within the projectile to provide electrical poser to the ultrasonic signal generator. In some embodiments, the non-Newtonian fluid transitions between states of varying viscosity based on the frequency of vibrations imparted to the fluid, thereby altering the projectile's impact characteristics. In some embodiments, the vibrations are emitted by an ultrasonic signal generator. In some embodiments, the apparatus further includes power circuitry interconnecting the power source and ultrasonic signal generator, wherein the power circuitry adjusts the output of the ultrasonic generator. In some embodiments, the control mechanisms are configured to adjust the frequency and amplitude of the vibrations emitted by the ultrasonic signal generator. In some embodiments, the projectile is composed of foam. In some embodiments, the foam is an open cell foam further comprising a skin to retain the fluid. In some embodiments, the foam is a closed cell foam. In some embodiments, the foam is made from starch.

In another embodiment, a method includes loading a projectile, wherein a non-Newtonian fluid is disposed within the projectile, selecting a desired level of lethality, adjusting the frequency and/or amplitude of vibrations delivered to the non-Newtonian fluid, and deploying the projectile towards a target. In some embodiments, the desired level of lethality corresponds to a predefined viscosity level of the non-Newtonian fluid, and wherein the viscosity level is achieved by tuning the frequency and amplitude of vibrations according to empirical data correlating viscosity levels of the non-Newtonian fluid to specific frequencies and amplitudes.

In another embodiment, a system includes a plurality of projectiles, wherein a non-Newtonian fluid is disposed within the projectile. In some embodiments, the projectile is tunable to a desired level of lethality. In some embodiments, the system further includes a firearm disposed to receive the projectile. In some embodiments, the firearm is a shotgun. In some embodiments, the firearm is a rifle. In some embodiments, the firearm is a pneumatic or other gas-powered guns such as the gun disclosed in patent application Ser. No. 18/590,043. The contents of PNEUMATIC RIFLE FOR ALTERNATE AMMUNITION, Chris Weiland, and Ser. No. 18/590,043, are herby incorporated by reference in their entirety.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

Figure 1:
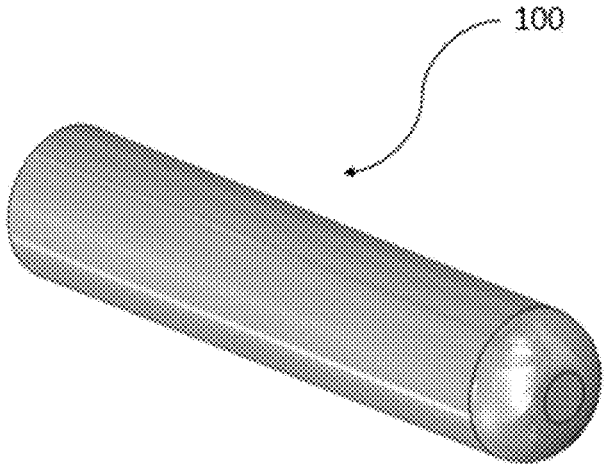
FIG. 1 is a view of a projectile.
Figure 2:
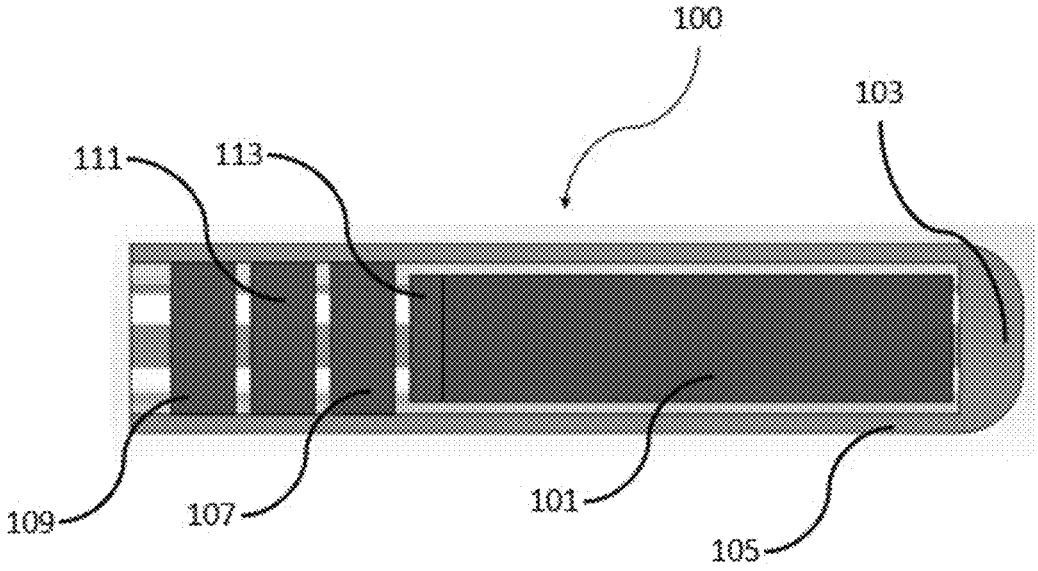
FIG. 2 is a cut-away view of the projectile.

FIG. 1 shows a view of projectile 100. In some embodiments, the projectile (round) is small, approximately 9 cm in length×2 cm in width, and weighs on the order of 20 grams. The projectile 100 can be either spin stabilized (i.e. rifled barrel) or drag stabilized (i.e. deploy streamers, etc.).

The projectile 100 is composed of foam. The projectile may be solid foam or contain a hollow region 101 aft of the projectile nose 103. If the foam used is of an open-cell configuration, a tight-fitting skin 105 prevent interior fluid from leaking out of the projectile 100. A closed-cell foam would not need the skin. It is desirable to make this foam out of a starch that is biodegradable if left out in the weather for extended period of time.

In either case (continuous or hollow projectile interior) a Non-Newtonian fluid is placed inside the projectile 100. This fluid can permeate the open-cell round or be contained in the hollow region 101 of the projectile 100.

Non-Newtonian fluids are materials that do not follow Newton's law of viscosity, meaning their viscosity (or flow behavior) changes under stress or strain and does not remain constant over time. Unlike Newtonian fluids, where the viscosity is constant regardless of the applied force or the rate of flow, the viscosity of non-Newtonian fluids depends on the shear rate or shear stress applied to them. The Non-Newtonian fluid may be any non-Newtonian fluid. In some embodiments, the non-Newtonian fluid is biodegradable. In some embodiments, the non-Newtonian fluid is corn starch and water, which is a heterogeneous suspension of corn starch particles in water. Over time, gravity will settle the particles; there are several methods for dealing with that eventuality.

Non-Newtonian fluids do not have a linear relationship between strain rate and stress. The corn starch and water mixture is an example of a dilatant fluid mixture: at small shear rates the fluid behaves almost like water, while at large shear rates the fluid behaves almost like a solid.

When embedded in the foam projectile 100, the Non-Newtonian fluid will naturally stiffen under a large shear rate—such as impact with a human body. Given the velocity of the projectile (which could be on the order of 100 m/s), this could do significant damage to a human body.

Corn starch and water mixtures are known to vary their response to shear rates in the presence of an ultrasonic signal. For example, a mixture that under appropriate shear rates would normally stiffen up to a solid-like body will behave like water in the presence of a strong ultrasonic field. An example of an ultrasonic signal can be found in many types of jewelry cleaners, where ultrasonic energy causes small-scale cavitation on solid objects. When the cavitation bubbles collapse, a cleaning effect is rendered to the object.

To counteract this shear thickening—and possible damage to the human—upon impact, projectile 100 uses a small embedded ultrasonic generator 107 to "tune" the apparent viscosity of the fluid mixture. The projectile 100 is programmed before being fired from a rifle to "tune" the impact lethality. This can be a manual programmed (i.e. a dial on the rifle) or automatically programmed (i.e. a laser range finder tunes the round to impact with a constant impact force based on range to target). In some embodiments, the project will be tuned/programmed wirelessly. From a practical perspective, the difference in behavior of the projectile terminal effects depends on the apparent viscosity of the Non-Newtonian fluid. If the ultrasonic generator 107 is turned OFF, the fluid will stiffen and essentially strike the human as a solid object. If the ultrasonic generator 107 is turned ON, the fluid will not stiffen, and essentially strike the human as a slug of water.

The ultrasonic signal generator 107 can produce high-frequency sound waves. The ultrasonic generator 107 operates at a range of frequencies. These sound waves manipulate the viscosity of the non-Newtonian fluid, thus altering the hardness and impact of the force of the projectile upon contact. The ultrasonic generator operates at a range of frequencies, allowing for precise control over the fluid's state and, consequently, the projectile's impact characteristics. Increasing the power (also known as amplitude) level to the ultrasonic generator 107 imparts more energy to the fluid.

The projectile 100 includes a power source 109, such as a battery, which provides the necessary energy to operate the ultrasonic generator 107 and the power circuitry 111. The power circuitry 111 is integrated to manage the distribution of power to the ultrasonic generator 107. The power circuitry 111 includes mechanisms for adjusting the intensity and frequency of the ultrasonic signals, enabling the user to tune the projectile's 100 lethality according to the desired level of force.

The projectile 100 may further include a vibration surface 113 in direct contact with the non-Newtonian fluid. The surface 113 transmits the vibrations from the ultrasonic generator 107 to the fluid, ensuring that the generated sound waves effectively alter the fluid's viscosity. The design of the vibration surface 113 is optimized to maximize the transfer of energy to the fluid, thereby enhancing the tunability of the projectile's 100 impact characteristics.

In some embodiments, the projectile 100 is largely biodegradable, except for the power source (battery) and ultrasonic generator. However, further research may yield biodegradable alternatives for each.

If the foam is non-soluble, ordinary water could be used. However, the round not be tunable.

The foam rounds described above are designed to work with a specific rifle—the SUDS rifle (disclosure forthcoming). However, the idea could also be applied to foam projectiles 100 shot out of, for example, a shotgun as traditional non-lethal rounds.

In practice, a user can select the desired level of lethality or impact force before deploying the projectile 100. This selection adjusts the frequency and intensity of the ultrasonic signals, which in turn modifies the viscosity of the non-Newtonian fluid. At lower settings, the fluid remains more fluid-like, allowing the projectile 100 to absorb more impact and reduce harm. At higher settings, the fluid behaves more like a solid, increasing the projectile's 100 hardness and impact force.

The disclosed projectile 100 offers a novel approach to managing use of force scenarios, providing law enforcement and military personnel with a versatile tool that can be adapted to a wide range of situations, minimizing the risk of serious injury while ensuring the effectiveness of crowd control and personal defense measures.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. An apparatus comprising:

a non-Newtonian fluid disposed within a projectile, wherein the projectile further includes an ultrasonic signal generator configured to emit vibrations at frequencies to tune the viscosity of the non-Newtonian fluid to a desired level of lethality.

2. The apparatus of claim 1, wherein the projectile further includes a vibration surface in direct contact with the non-Newtonian fluid, wherein the vibration surface is configured to impart vibrations generated by the ultrasonic signal generator to the non-Newtonian fluid.

3. The apparatus of claim 1, wherein the projectile further includes a power source housed within the projectile to provide electrical power to the ultrasonic signal generator.

4. The apparatus of claim 3, further comprising power circuitry interconnecting the power source and ultrasonic signal generator, wherein the power circuitry adjusts the output of the ultrasonic generator.

5. The apparatus of claim 4, wherein a control mechanisms are configured to adjust the frequency and amplitude of the vibrations emitted by the ultrasonic signal generator.

6. The apparatus of claim 1, wherein the non-Newtonian fluid transitions between states of varying viscosity based on the frequency of vibrations imparted to the fluid, thereby altering the projectile's impact characteristics.

7. The apparatus of claim 6, wherein the vibrations are emitted by an ultrasonic signal generator.

8. The apparatus of claim 1, wherein the projectile is composed of foam.

9. The apparatus of claim 8, wherein the foam is an open cell foam further comprising a skin to retain the fluid.

10. The apparatus of claim 8, wherein the foam is a closed cell foam.

11. The apparatus of claim 8, wherein the foam is made from starch.

12. A method comprising:

loading a projectile, wherein a non-Newtonian fluid is disposed within the projectile, and the projectile further includes an ultrasonic signal generator configured to emit vibrations at frequencies to tune the viscosity of the non-Newtonian fluid to a desired level of lethality;

selecting a desired level of lethality;

adjusting the frequency and/or amplitude of vibrations delivered to the non-Newtonian fluid; and deploying the projectile towards a target.

13. The method of claim 12, wherein the desired level of lethality corresponds to a predefined viscosity level of the non-Newtonian fluid, and wherein the viscosity level is achieved by tuning the frequency and amplitude of vibrations according to empirical data correlating viscosity levels of the non-Newtonian fluid to specific frequencies and amplitudes.

14. A system comprising:

a plurality of projectiles, wherein a non-Newtonian fluid is disposed within the projectile, wherein each projectile further includes an ultrasonic signal generator configured to emit vibrations at frequencies to tune the viscosity of the non-Newtonian fluid to a desired level of lethality.

15. The system of claim 14, wherein the projectiles are tunable to a desired level of lethality.

16. The system of claim 14, the system further comprising a firearm disposed to receive the projectiles.

17. The system of claim 16, wherein the firearm is a shotgun.

18. The system of claim 16, wherein the firearm is a rifle.

19. The system of claim 16, wherein the firearm is a pneumatic or other gas-powered gun.

* * * * *